US009793067B2

(12) United States Patent
Muenzberg et al.

(10) Patent No.: US 9,793,067 B2
(45) Date of Patent: Oct. 17, 2017

(54) SEPARATELY HOUSED CONTACT ASSEMBLY MOUNTED WITHIN A TRANSFORMER

(71) Applicant: Maschinenfabrik Reinhausen GmbH, Regensburg (DE)

(72) Inventors: Christian Muenzberg, Biburg (DE); Andreas Raith, Deggendorf (DE)

(73) Assignee: MASCHINENFABRIK REINHAUSEN GMBH, Regensburg (DE)

( * ) Notice: Subject to any disclaimer, the term of this patent is extended or adjusted under 35 U.S.C. 154(b) by 0 days.

(21) Appl. No.: 15/030,321

(22) PCT Filed: Nov. 10, 2014

(86) PCT No.: PCT/EP2014/074140
§ 371 (c)(1),
(2) Date: Apr. 18, 2016

(87) PCT Pub. No.: WO2015/071209
PCT Pub. Date: May 21, 2015

(65) Prior Publication Data

US 2016/0293351 A1 Oct. 6, 2016

(30) Foreign Application Priority Data

Nov. 12, 2013 (DE) ..... 10 2013 112 405

(51) Int. Cl.
*H01H 19/00* (2006.01)
*H01H 9/00* (2006.01)
*H01H 1/50* (2006.01)

(52) U.S. Cl.
CPC ..... *H01H 9/0044* (2013.01); *H01H 1/50* (2013.01); *H01H 9/0016* (2013.01); *H01H 2235/01* (2013.01)

(58) Field of Classification Search
CPC .... H01H 19/12; H01H 9/0005; H01H 9/0016; H01H 9/0044; H01H 33/662; H01F 29/04
(Continued)

(56) References Cited

U.S. PATENT DOCUMENTS 7,872,203 B2 * 1/2011 Lindsey ..... H01H 9/0044 200/11 TC
8,030,583 B2 10/2011 Hammer
8,153,917 B2 * 4/2012 Xiao ..... H01H 9/0016 200/11 TC

FOREIGN PATENT DOCUMENTS

DE 2754682 A 5/1979
GB 887369 B 1/1962
GB 1263640 B 2/1972

* cited by examiner

*Primary Examiner* — Vanessa Girardi
(74) *Attorney, Agent, or Firm* — Andrew Wilford

(57) ABSTRACT

The present invention relates to a contact unit for changing over between winding taps on a control winding of a tapped transformer. Such a contact unit can be used particularly preferably for electrical switchgear in high-voltage engineering, such as selector switches or changeover switches. A common feature of both kinds of device in this case is that the changeover between the winding taps on the control winding of the tapped transformer is accomplished without load current. The general inventive concept is to include the contact element of the contact unit in a separate contact housing, so that the contact element and the contact housing form a separate assembly and so that the contact housing, including the contact element, can be fixed in a recess provided in the contact mounting by means of a retaining element.

17 Claims, 5 Drawing Sheets

(58) Field of Classification Search
USPC ..... 200/11 TC, 254
See application file for complete search history.

SEPARATELY HOUSED CONTACT ASSEMBLY MOUNTED WITHIN A TRANSFORMER

CROSS REFERENCE TO RELATED APPLICATIONS

This application is the US-national stage of PCT application PCT/EP2014/074140 filed 10 Nov. 2014 and claiming the priority of German patent application 102013112405.4 itself filed 12 Nov. 2013.

FIELD OF THE INVENTION

The present invention relates to a contact assembly for change-over switching between winding taps of a control winding of a tapped transformer. Such a contact assembly is particularly preferably applicable for electrical switchgear in high-voltage technology, such as tap selectors or off-circuit tap-changers. Both types of devices have in common that change-over switching between the winding taps of the control winding of the tapped transformer is carried out load-current-free.

BACKGROUND OF THE INVENTION

Known from the German patent specification DE 27 54 682 is a tap selector for a tap changer of tapped transformers with a stationary tap selector column having contact rings arranged at different levels per phase and connected with connection lines inside the tap selector column. For increasing the torsional strength of the drive tubes, DE 27 54 682 proposes that the contact bridge housing supported by the inner drive tube is fastened at the inner drive tube by an arc-shaped attachment piece being arranged in each case above and below the contact bridge and being adapted to the tube diameter, and that both these arc-shaped attachment pieces and the contact bridge project through a respective recess extending along the circumference in the outer drive tube.

The actual contact in DE 27 54 682 is constructed as contact bridge that establishes an electrically conductive connection between the current ring assigned to it on one side and the tap selector connection contact on the other side. In this context, the contact is arranged in a contact bridge housing fixedly connected with the drive tube is therefore difficult to access or replace, as the case may be, for maintenance work. In addition, constructing the entire contact assembly is a laborious and time-consuming task for the manufacturer.

OBJECT OF THE INVENTION

The object of the present invention is therefore to provide a contact assembly for change-over switching between winding taps of a control winding for a tapped transformer, which contact assembly is easy to assemble and can be replaced quickly and easily for maintenance purposes.

SUMMARY OF THE INVENTION

The general inventive idea consists in accommodating the contact of the contact assembly in a separate contact housing such that the contact and the contact housing form a separate module and such that the contact housing together with the contact are fixable in a recess provided in the contact mount by a retaining element.

It is furthermore advantageous for the contact housing to be constructed as a receptacle open on two opposite sides, namely on a front side and on a back side, and to have a flange-type shielding ring in the area of the front side at the outer circumference of the contact housing.

In addition, the contact housing can have spring retainers at an upper side and/or at a lower side, respectively, for spring-mounting the contact, which spring retainers penetrate the upper side and/or the lower side of the contact housing, and compression springs can be arranged between the contact and the spring retainers.

It is possible for the spring retainer to have a groove with a groove floor and a wedge-shaped ramp. The retaining element can then be U-shaped and have a retaining bracket and arms that are hollow. It is additionally conceivable to form the retaining bracket as a sheet metal bracket. The retaining bracket can also be formed to engage into the groove in a form-locking and contact-closing manner in the locked state of the separate module. Furthermore, a compression spring can be provided in each of the arms of the retaining element, which compression spring in each case interacts with a bolt provided at a cover in such a manner that the cover fixedly mounted in the contact mount by anchor bolts compresses the respective compression spring with its bolts using a defined prestress and thus presses the retaining bracket into the groove.

It can also be advantageous to provide a slot in the contact, into which slot a pin engages that is fixedly arranged at the contact housing. The contact can be constructed as a blade contact consisting of a plurality of individual contacts, which contact projects longitudinally to both sides beyond the contact housing.

Finally, there is the possibility that the contact mount has at least one aperture in which a support, preferably an extruded rod, is receivable. Alternatively, the support can also be made of laminated paper or laminated fabric. By constructing both the support and the contact mount from an electrically non-conductive material, it is possible to hold high voltages over the regulating range between the connection contacts and the take-off ring in a small installation space.

BRIEF DESCRIPTION OF THE DRAWING

Further developments, advantages, and application possibilities of the invention also arise from the following description of illustrated embodiments and from the figures. All of the described and/or illustrated features, alone or in any combination, are fundamentally the subject matter of the invention, regardless of their summary in the claims or their dependency.

In the following, the invention will be illustrated exemplarily in more detail by means of drawings, in which.

SPECIFIC DESCRIPTION OF THE INVENTION

Figure 1A:
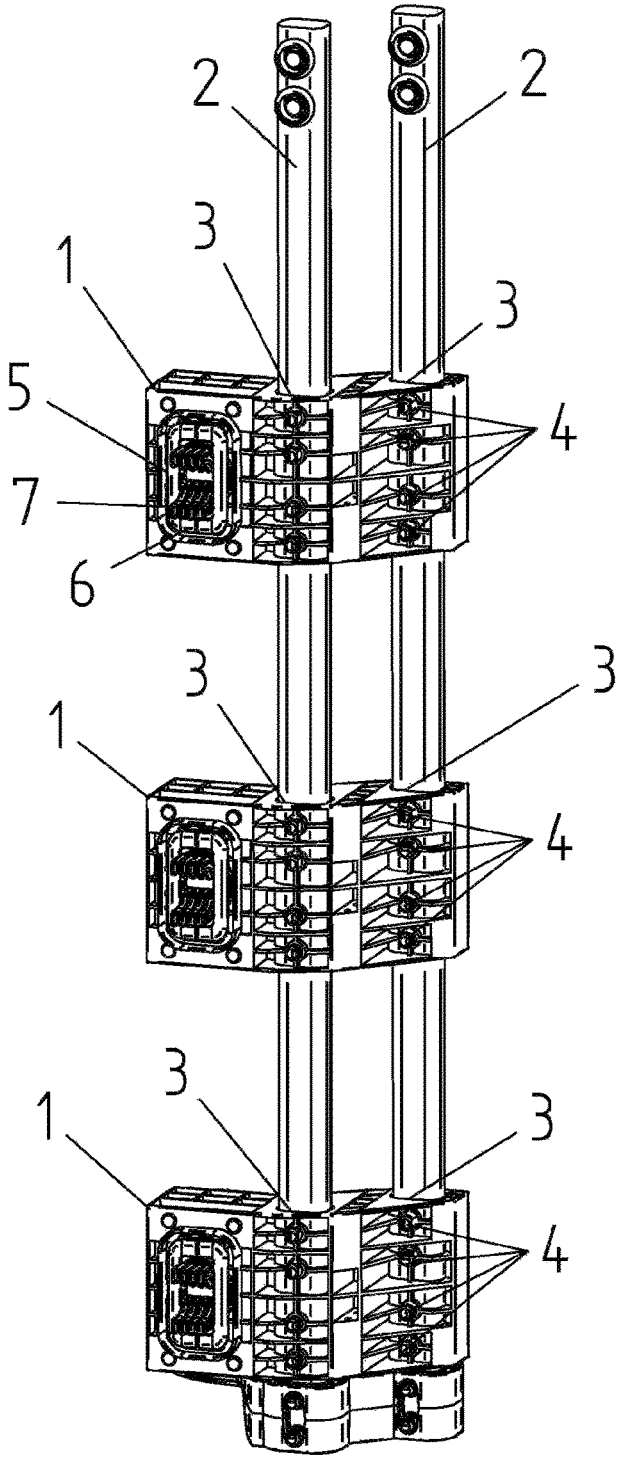
FIG. 1*a* is a schematic illustration of a contact assembly.

The same or equivalent elements of the invention are designated by identical reference characters. The illustrated embodiment merely represents a possible construction for a contact assembly for change-over switching between winding taps of a control winding of a tapped transformer.

FIG. 1*a* is a schematic illustration of a contact assembly according to the invention as an example of a three-phase application in a selector or in an off-circuit tap-changer for a tapped transformer. Electrical high-voltage switching devices of this type, such as selectors or off-circuit tap-changers that serve for current- and voltage-free change-over switching between winding taps of a control winding of the tapped transformer have been known to the expert for decades. In this instance, each contact assembly according to the invention as shown in FIG. 1*a* has a contact mount 1 fastenable at least one extruded rod serving as support 2 for the corresponding contact assembly. In the present illustrated embodiment, two rods arranged essentially in parallel are provided as the support 2. It is likewise conceivable in the context of the invention to vary the number, the geometric profile, the geometric positioning of the used rods in relation to one another, and also the selection of material they are made of. The contact mount 1 can be constructed as an injection-molded part or as an SMC part, and it can have a proportion of glass fiber mixture of 50%, for example. Preferably, the contact mount 1 is an electrically non-conductive component. Furthermore, the contact mount 1 is preferably formed in one part, and, for mechanically fixing it, it is provided with one aperture 3 per each of the support 2, into which aperture 3 the corresponding support 2 is inserted and fixedly mounted by fixing elements 4. Shown in FIG. 1*a* are two apertures 3, into which the two rods serving as support 2 are insertable. Thermoplastic bolts with snap-in lugs for one-time securing, for example, can be used as fixing elements 4. The respective inside diameter or its geometric form, as the case may be, of each aperture 3 and the outside diameter of the corresponding support 2 in this instance only vary by a few tenths of a millimeter such that the support 2 is essentially already mounted in a contact-closing manner only by being inserted into the corresponding aperture 3. A mechanical form-lock is eventually achieved once the fixing elements 4 have been attached. In addition, each contact mount 1 has a recess 5, into which a separate contact housing 6 with the corresponding contact 7 is insertable and mechanically fixable by a retaining element 8 that is not illustrated here. Which components engage in which way with each other for this purpose is to be gathered in detail from the description of figures following below. In the illustration of FIG. 1*a*, the apertures 3 of the corresponding contact mounts 1 are arranged on the right side of the respective recesses 5. It is, however, likewise conceivable in the context of the invention to provide the apertures 3 on the left side of the recesses 5 or, alternatively, between the apertures 3. This ultimately depends on how the contact assembly according to the invention has to be installed in a selector or in an off-circuit tap-changer, or, as the case may be, on how a particularly space-saving wiring of the fixed contacts of the corresponding high-voltage switching device can be carried out.

Figure 1B:
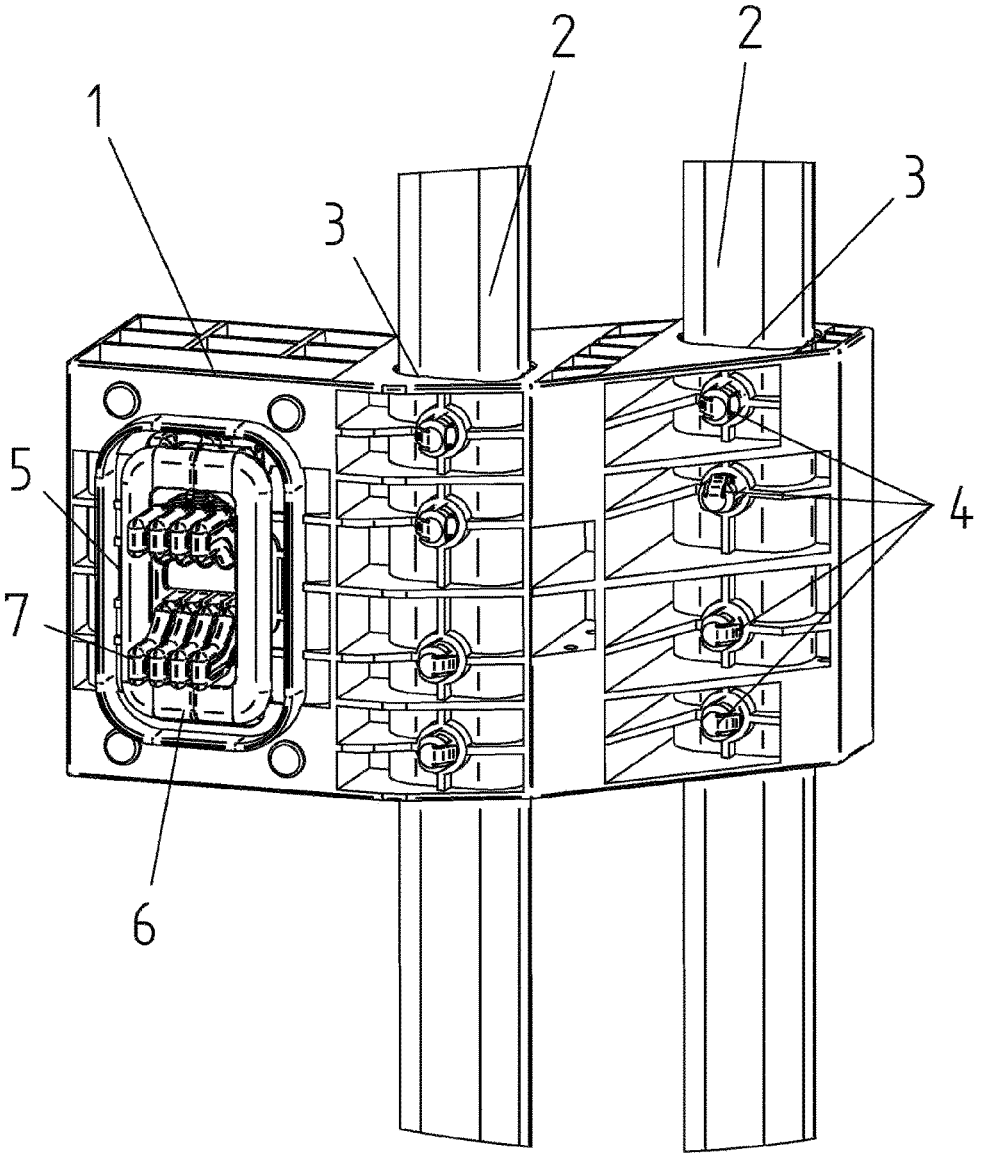
FIG. 1*b* is a detailed view of the contact assembly.

FIG. 1*b* shows a detailed view of an individual contact assembly also arranged at two extruded rods serving as support 2. For the purpose of increasing the mechanical stability and to save material, the contact mount 1 has a plurality of webs in the area of the apertures 3, and also in the area of the recesses 5. On the whole, this results in a particularly lightweight and mechanically stable overall construction for the contact mount 1.

Figure 2A:
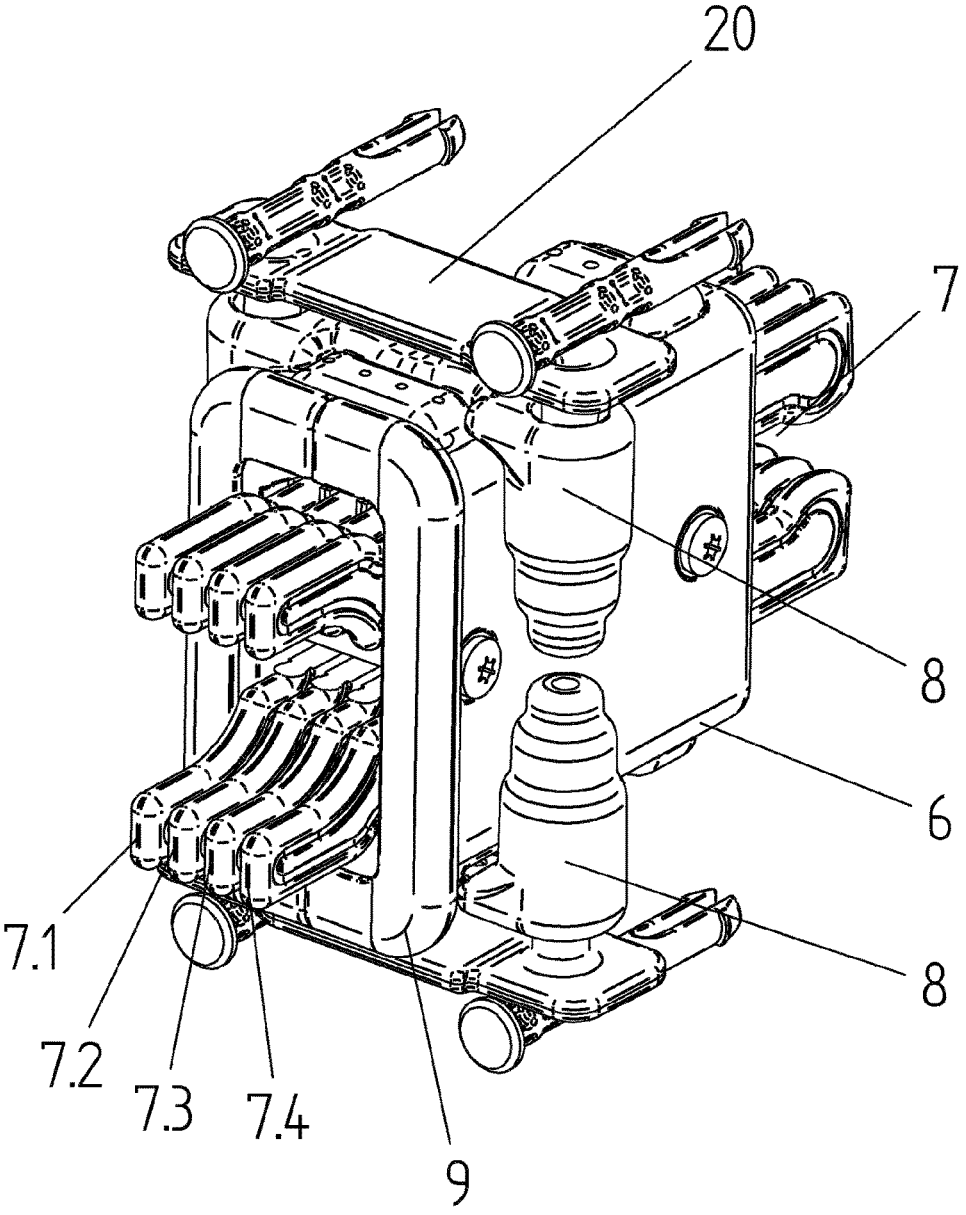
FIG. 2*a* is a detailed view of a contact housing with a contact.
Figure 2B:
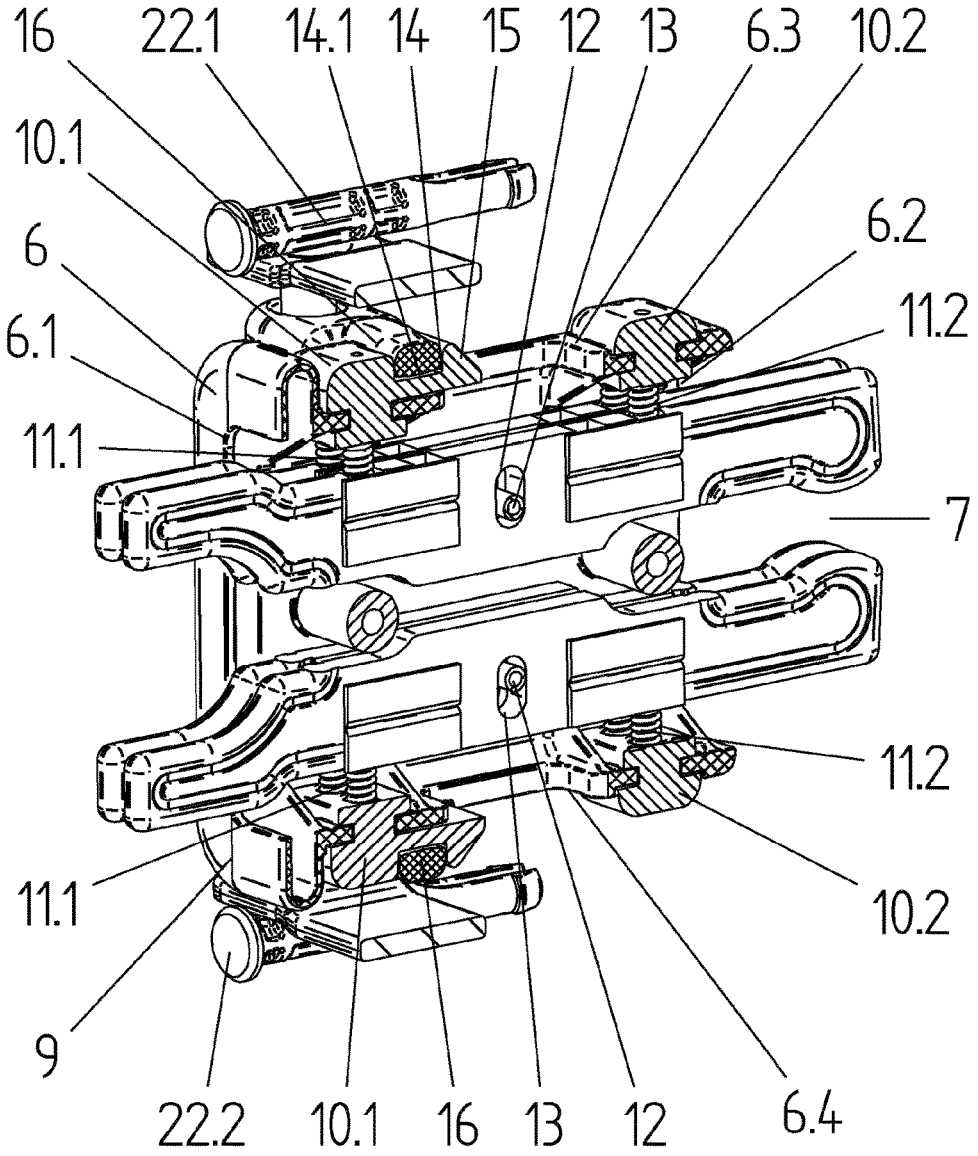
FIG. 2*b* is a lateral sectional view of the contact housing with the contact.

Shown in FIGS. 2*a* and 2*b* are a detailed view and a sectional view, respectively, of the contact housing 6 with the contact 7 and also of the essential components for mounting the contact housing 6 together with the contact 7 in the contact mount 1. Preferably made of an electrically conductive material, in particular of a conductive synthetic material, the contact housing 6 is formed as an essentially cuboid-shaped receptacle constructed so as to be open on two opposite sides, namely on a front side 6.1 and on a back side 6.2. In addition, a flange-type shielding ring 9 is provided in the area of the front side 6.1 at the outer circumference of the contact housing 6 for the purpose of electrical shielding. The contact 7 is accommodated in a spring-mounted manner inside the contact housing 6. The contact 7 is constructed as a blade contact 7.1 . . . 7.4 of a plurality of individual contacts arranged essentially in parallel to each other, which contact 7 projects longitudinally to both open sides, thus both to the front side 6.1 and to the back side 6.2, beyond the contact housing 6. For spring-mounting the individual contact blades 7.1 . . . 7.5, the contact housing 6 provides in each case two spring retainers 10.1 and 10.2 at an upper side 6.3 or at a lower side 6.4, which spring retainers 10.1 and 10.2 penetrate the upper side 6.3 or the lower side 6.4 of the contact housing 6, as the case may be, and at which spring retainers 10.1 and 10.2 one compression spring 11.1 and 11.2 for each of the contact blades 7.1 . . . 7.4 is arranged on the inner sides facing toward the contact blades 7.1 . . . 7.4. In this context, the height displaceability of the individual contact blades 7.1 . . . 7.4 is defined by a slot 12 provided in the respective contact blades 7.1 . . . 7.4 and into which a pin 13 engages that is fixedly arranged at the contact housing 6. The contact housing 6 together with the components therein, namely the contact 7 and also the spring retainers 10.1 and 10.2, form a pre-mounted, separate module lockably and detachably mounted by way of simply being inserted into the contact mount 1. For the purpose of locking the contact housing 6 into the contact holder 1, the contact housing 6 has a groove 14 with a groove floor 14.1 and also a wedge-shaped ramp 15 at the spring retainer 10.1 facing toward the front side 6.1, where a retaining bracket 16 of an essentially U-shaped retaining element 8 received into the contact holder 1 is formed such that the retaining bracket 16 engages form-lockingly, i.e. fitting precisely, into the groove 14 of the retaining element 8. In order for the retaining bracket 16 to be pressed against the groove floor 14.1 at a defined contact force in the locked, i.e. in the mounted state, a compression spring 19.1 and 19.2, not illustrated in FIGS. 2*a* and 2*b*, is provided in each of the hollow-shaped arms 18.1 and 18.2 of the U-shaped retaining element 8, where each compression spring 19.1 and 19.2 interacts with a bolt 21.1 and 21.2 provided at a cover 20 in such a manner that the cover 20 fixedly mounted in the contact mount 1 by anchor bolts 22.1 and 22.2 compresses the respective compression spring 19.1 and 19.2 with its bolts 21.1 and 21.2 using a defined prestress and thus presses the retaining bracket 16 into the groove 14. A floating mounting is thus realized for the contact 7 at the same time, which floating mounting prevents a certain height offset of the contact assembly due to manufacturing tolerances in an installed state in a high-voltage switching device, and thus prevents an uneven material abrasion at the contact blades 7.1 . . . 7.4 caused by different contact forces.

Figure 3:
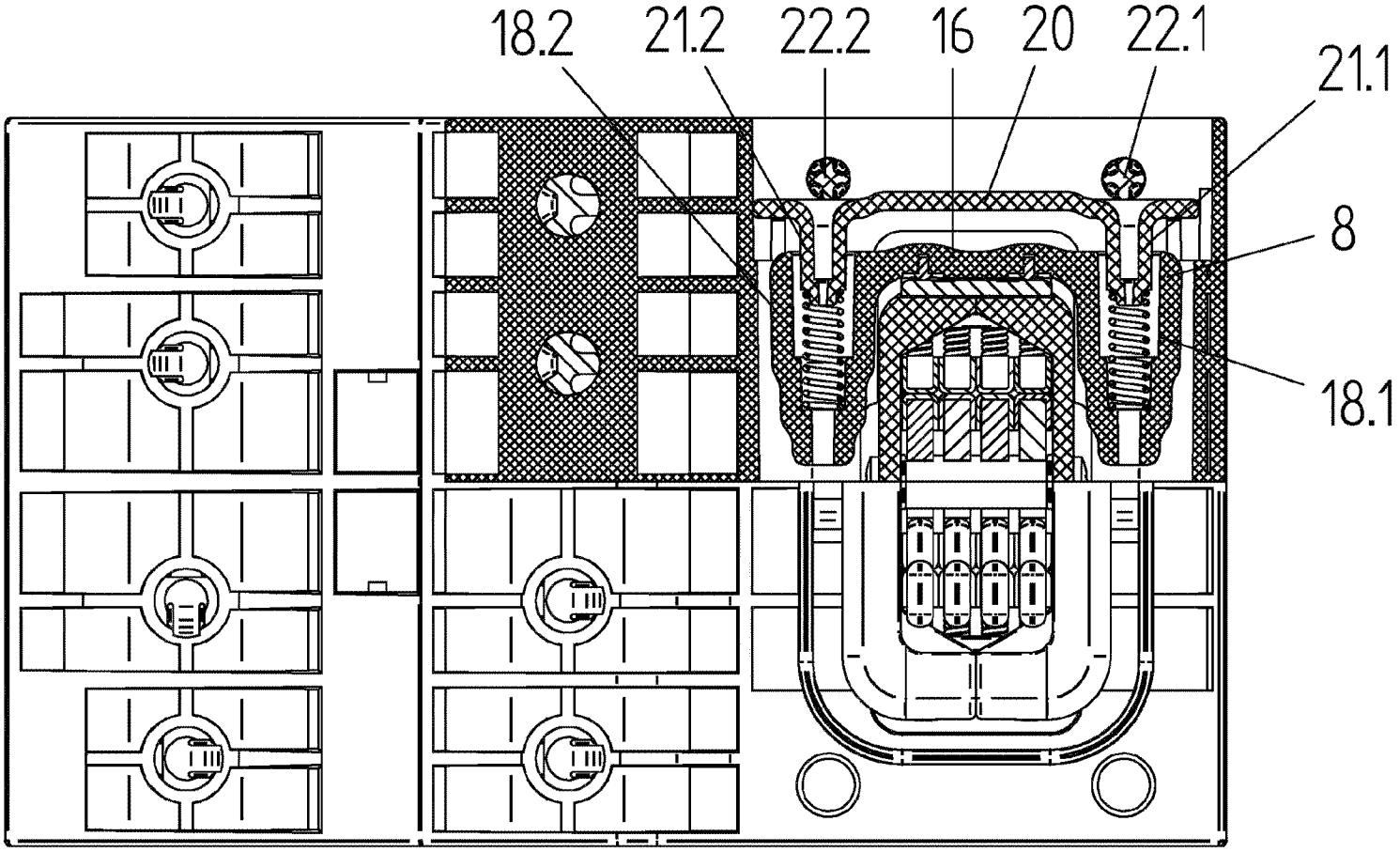
FIG. 3 is a further lateral sectional view of the contact mount with the inserted contact housing.

FIG. 3 shows a further lateral sectional view of the contact holder 1 with the inserted contact housing 6. In this instance, the retaining element 8 with the compression springs 19.1 and 19.2 arranged in the hollow arms 18.1 and 18.2 and the cover 20 with the bolt 21.1 and 21.2 are assigned to the recess 5 of the contact mount 1 and mechanically fixed in the recess 5 by the anchor bolts 22.1 and 22.2. When mounting the contact housing 6 together with the contact 7 as a separate module, this module is inserted in the direction of the arrow into the recess 5 of the contact mount 1, where the components assigned thereto, namely the retaining element 8, the compression springs 19.1 and 19.2, the cover 20, and the anchor bolts 22.1 and 22.2 have been pre-mounted. For this purpose, the retaining bracket 16 slides from the back side 6.2 in the direction toward the front side 6.1 along the upper or lower side 6.3 and 6.4, as the case may be, over the spring retainer 10.1 and subsequently over the ramp 15, until the retaining bracket 16 locks into the groove 14. In order to detach the separate module of the contact housing 6 together with the contact 7, a tool has to be inserted between the two ends of the arms 18.1 and 18.2 facing toward, and the bolt 21.1 and 21.2 have to be pushed apart against the spring force of the corresponding compression springs 19, until the retaining bracket 16 is lifted up from the groove floor 14.1 by the height difference of the groove 14, and the separate module can thus be pulled out of the recess 5 of the contact mount 1 against the direction of the arrow.

The invention claimed is:

1. A contact assembly for change-over switching between winding taps of a control winding of a tapped transformer, the contact assembly comprising:

at least one support carrying the contact assembly;

a contact mount mechanically fixable on the at least one support and formed with a throughgoing recess;

a contact made of an electrically conductive material;

a separate contact housing having a front side and a back side and holding the contact such that the contact and the contact housing form a separate module; and a separate retaining element securing the contact housing together with the contact in the recess with the contact mount surrounding the module between the front and back sides, the front side exposed at one end of the recess, and the back side exposed an opposite end of the recess.

2. The contact assembly according to claim 1 wherein the contact housing is a receptacle open on a front side and on a back side, and has a flange-type shielding ring on the front side on an outer surface of the contact housing.

3. The contact assembly according to claim 1, further comprising:

a slot in the contact; and a pin fixed on the contact housing and engaging into the slot.

4. The contact assembly according to claim 1, wherein the contact is constructed as a blade contact consisting of a plurality of individual subcontacts that project longitudinally to both sides beyond the contact housing.

5. The contact assembly according to claim 1 for use in a tap selector or in an off-circuit tap-changer.

6. The contact assembly according to claim 1, wherein the contact housing has an upper side and a lower side, further comprising:

spring retainers at the upper side and/or at the lower side for spring-mounting the contact.

7. The contact assembly according to claim 6, wherein the spring retainers extend through the upper side and/or the lower side of the contact housing, the contact assembly further comprising a respective compression spring provided between the contact and each of the spring retainers.

8. The contact assembly according to claim 6, wherein each spring retainer has a wedge-shaped ramp and a groove with a groove floor.

9. The contact assembly according to claim 6, wherein each retaining element is U-shaped and has a retaining bracket and arms.

10. The contact assembly according to claim 1 wherein the contact mount has at least one aperture receiving the support.

11. The contact assembly according to claim 1 wherein the support is an extruded rod or made of laminated paper or of laminated fabric.

12. The contact assembly according to claim 10 wherein there are at least two of the apertures.

13. The contact assembly according to claim 10 wherein the recess of the contact mount is between and/or laterally adjacent the apertures.

14. A contact assembly for change-over switching between winding taps of a control winding of a tapped transformer, the contact assembly comprising:

at least one support carrying the contact assembly;

a contact mount mechanically fixable on the at least one support and formed with a recess;

a contact made of an electrically conductive material;

a separate contact housing holding the contact such that the contact and the contact housing form a separate module, the contact housing having an upper side and a lower side;

respective upper and lower spring retainers at the upper and lower sides securing the contact in the contact housing; and a U-shaped retaining element having a bracket and arms securing the contact housing together with the contact in the recess.

15. The contact assembly according to claim 14, wherein each spring retainer has a wedge-shaped ramp and a groove with a groove floor, the retaining bracket being formed to engage into the groove in a form-locking and contact-closing manner in a locked state of the separate module.

16. The contact assembly according to claim 14 wherein the arms are hollow.

17. The contact assembly according to claim 16, further comprising:

a respective compression spring provided in each of the arms of the retaining element;

a cover;

anchor bolts fixing the cover on the contact mount; and a respective bolt provided on the cover, carrying a respective one of the compression springs, and compressing the compression springs using a defined prestress and thus pressing the retaining bracket into the groove.

* * * * *